United States Patent [19]

Williams

[11] Patent Number: 4,973,278

[45] Date of Patent: Nov. 27, 1990

[54] FLOATABLE PORTABLE SEAT AND METHOD FOR USE

[76] Inventor: Thomas R. Williams, P.O. Box 845, Ketchum, Id. 83340

[21] Appl. No.: 396,000

[22] Filed: Aug. 21, 1989

Related U.S. Application Data

[63] Continuation-in-part of Ser. No. 246,782, Sep. 20, 1988, abandoned.

[51] Int. Cl.[5] ..... B63B 35/76

[52] U.S. Cl. ..... 441/131

[58] Field of Search ..... 114/351; 441/129–132, 441/108–110

[56] References Cited

U.S. PATENT DOCUMENTS

| | | | |
|---|---|---|---|
| 1,598,457 | 8/1926 | Sommer | 441/131 |
| 2,327,169 | 8/1943 | Bucknell | 441/131 |
| 2,529,961 | 11/1950 | Phillips | 441/131 |
| 3,432,868 | 3/1969 | Lowery | 441/131 |
| 4,701,145 | 10/1987 | Foresman | 441/131 |

*Primary Examiner*—Sherman Basinger

[57] ABSTRACT

A floatable portable seat for use by sportsmen while floating on a body of water which is easier to get into and which is much safer to operate as well as much easier to fish from which comprises an inflatable tube which is discontinuous at least at one point to provide two terminal ends which can later be joined together to form a substantially complex tubing, buckles at each of the ends adapted to bringing the ends together and temporarily locking the ends together, an oversized seat structure attached to the bottom insides of the tubing and having buckles near the front of the seat adapted to being joined later to the front of the terminal ends, the seat being of such a size as to permit the tubing to be opened to allow the person to squeeze between the two ends and get inside the tubing yet when the ends are closed to provide a suitable seat structure to hold the person as if he was sitting on the water.

7 Claims, 4 Drawing Sheets

FLOATABLE PORTABLE SEAT AND METHOD FOR USE

This application is a continuation-in-part application of my application Ser. No. 246,782, filed Sept. 20, 1988, and now abandoned.

BACKGROUND OF THE INVENTION

1. Field of the Invention

This invention relates to a new floatable portable seat device. More particularly, the invention relates to a new floatable portable seat device which holds a person in a sitting position while he is floating on the water to give him the appearance of sitting on the surface of the water.

Specifically, the invention provides a new type of floatable portable seat device for use by sportsmen while floating on a body of water which is easier to get into and which is much safer to operate and get into and which permits the person to have his arms free for fishing purposes. The new floatable portable seat device broadly comprises an inflatable tube possessing two terminal enclosed tube ends, which tube is discontinuous at at least one end point to provide the two terminal ends which can later be joined together to form a complete tubing, joining means at each of the tube ends adapted to bringing the tube ends together and temporarily locking the ends together, joining means at each of the tube ends adapted to attaching the tubing directly to the front end of the seat structure, an oversized seat structure attached directly to the bottom inside of the tubing near the part of the tubing opposite the tube ends and extending out from the bottom of the tubing to give support to the person sitting thereon so that the person is sitting near the surface of the water and has his arms free for fishing, and the seat is of such a size as to permit the tubing to be opened to allow the person to squeeze between the two tube ends and get inside the tubing and when the tube ends are closed together to provide a seat structure sufficient to hold a person in a sitting position near the surface of the water with his arms free for fishing and with openings in the seat to permit his legs to pass down under the tubing.

The invention further provides a method for using the above-described inflatable portable seat device, particularly for fishing purposes, which comprises inflating the said tubing with air pressure, placing the inflated tubing around the fisherman's waist by passing the body through the opening in the circular tubing, securing the two ends of the circular tubing together by the joining means at the said ends, and then joining the means at the front end of the seat structure with the joining means on the two said ends so as to provide a seat for the fisherman to hold him in a sitting position with openings in front of the seat to permit his legs to pass down under the tubing.

2. Prior Art

There is a growing interest in recreational fishing in the use of float tube fishing. Rather than use a boat, a person who wants to fish in a different manner will put on waterproof waders, with flippers on the feet to act as a means of propulsion and then climb into a circular floating device similar to an inflated rubber inner tube. This particular type of apparatus has a webbed seat or nylon canvas for the person to sit on and the position of the seat plus the floatation of the inflated tube will hold the person's upper body nearly out of the water while the legs rest down in the water. Examples of this include devices disclosed in U.S. Pat. Nos. 4,687,452, 3,324,488, 2.894,270, 4,601,667 and 2,958,876.

The use of such float tubes requires a remarkable degree of skill and balance to get into and operate such a device due to the attached seat in the float tube surround a fully inflated circular tubing. This places a considerable limitation on the sport as only the most coordinated sportsman can use the tubes. They not only have to walk on land and shallow water with large and stiff flippers, but also have to perform a balancing act that is even more daring in the cold ice water as they try with all that equipment to put their legs from the top down into the openings in the tubing without falling over in the water.

Sommer-U.S. Pat. No. 1,598,457 discloses a chair for use by swimmers where the chair portion is attached by long straps to the tubing so that the person is sitting down in the water and is not free for fishing purposes.

It is an object of the invention, therefore, to provide a solution to the above difficulties and provide a new device which will greatly increase the use of the float tube by fishermen. It is a further object to provide a new float tube device, which is easier to get into and avoids the need for the balancing act required for the prior tubes. It is a further object to provide a new float tube which holds the person near the surface of the water and permits him to have his arms free for fishing. It is a further object to provide a much safer tube for use by fishermen. These and other objects will be apparent from the following detailed description thereof.

SUMMARY OF THE INVENTION

It has now been discovered that these and other objects of the invention can be accomplished by the new float tube device of the present invention which presents for the first time a safe and easily operated device for use by fisherman.

The new floatable portable seat device of the present invention broadly comprises in combination an inflatable tube possessing two terminal enclosed tube ends, which tube is discontinuous at at least one end point to provide the two terminal ends which can later be joined together to form a complete tubing, joining means at each of the tube ends adapted to bringing the tube ends together and temporarily locking the ends together, joining means at each of the tube ends adapted to attaching the tubing directly to the front end of the seat structure, an oversized seat structure attached directly to the bottom inside of the tubing near the part of the tubing opposite the tube ends and extending out from the bottom of the tubing to give support to the person sitting thereon so that the person is sitting near the surface of the water and has his arms free for fishing, and the seat is of such a size as to permit the tubing to be opened to allow the person to squeeze between the two tube ends and get inside the tubing and when the tube ends are closed together to provide a seat structure sufficient to hold a person in a sitting position near the surface of the water with his arms free for fishing and with openings in the seat to permit his legs to pass down under the tubing.

The float tube device of the present invention is surprisingly easy to assemble and to be utilized by the sportsman. After being inflated the new device can be placed around the fisherman while he is on land or in the water and whether he has the waders and flippers on or off, and then the two ends can be joined together and temporarily locked in position, and the front of the seat joined to the joining means near the terminal ends of the tube and thus provide a seat where the fisherman can be comfortably seated when floating and fishing.

Because of the unique arrangement of the device, the fisherman sitting on the seat is sitting substantially near the surface of the water and thus has excellent view of the water area and has his arms and hands free for holding and casting the fishing rod as shown in the drawings. This presents a distinct advantage over the prior known seats wherein the person is held down in the water and is not able to function as a fisherman.

The new float tubes are also not only easy to put on without any great balancing act, and thus adapted for use by any fisherman wanting to adopt the sport, but it is also much safer to utilize in that it can be easily disassembled and the fisherman can removed the device by merely unhooking the joining means in the front of the tubing device.

DESCRIPTION OF THE DRAWINGS

The various objects and features of the present invention will be more fully understood by reference to the accompanying drawings.

DETAILED DESCRIPTION OF THE DRAWINGS

Figure 1:
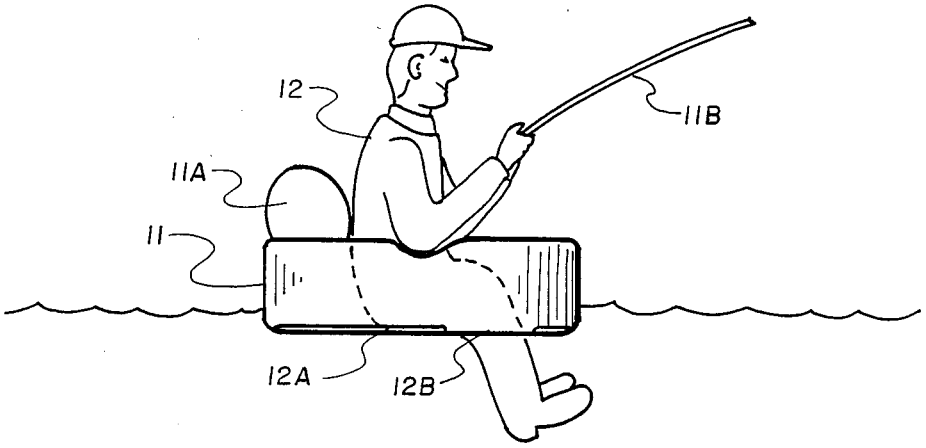
FIG. 1 is an illustration of a fisherman utilizing the float device of the present invention.

Referring to FIG. 1 which is an illustration of a fisherman sitting in the float tube device, the tube is broadly illustrated as 11 with backrest 11A and the fisherman 12 sitting in the tube on the seat 12A inside the tubing with openings 12B for his legs to go down through the tubing into the water. FIG. 1 illustrates how the fisherman can use the tubing for fishing as indicated by fishing pole 11B.

Figure 2A:
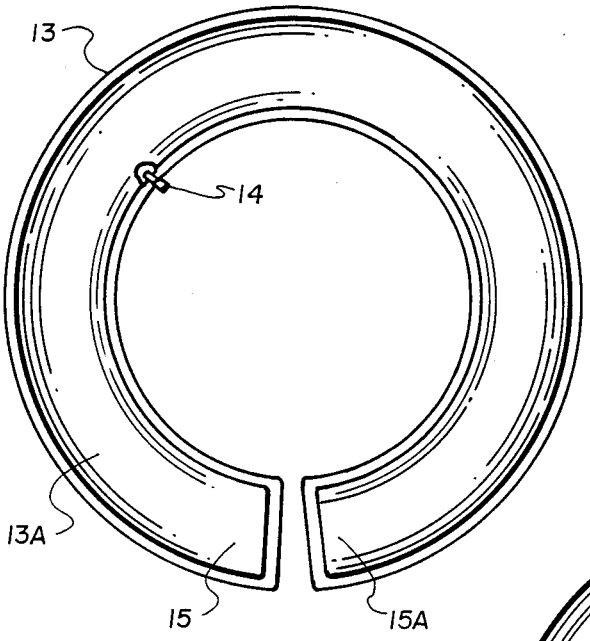
FIG. 2A is a top view of a preferred tube assembly wherein the inflatable tube is placed within an outer casing, and is free of other features, such as apron, back rest, pockets, etc. which are present in the completed device.
Figure 3:
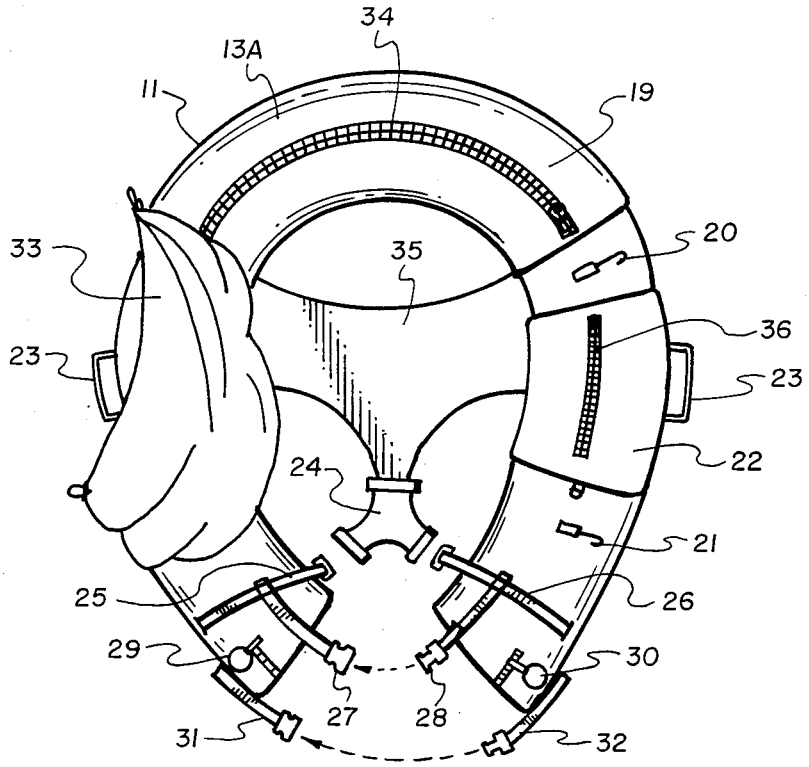
FIG. 3 is a top view of the new float device with the circular tube in the open position and showing the various features and attachments to the tube.

FIG. 2A is an illustration of the preferred tube assembly free of the various features, such as back rest, pocket, apron, seat assembly, etc. which are present on the completed device shown in FIG. 3. FIG. 2A shows an outer casing 13, such as made of nylon canvas, with the inner rubber tubing 13A with inflation valve 14. The open terminal ends are shown as 15 and 15A.

Figure 2B:
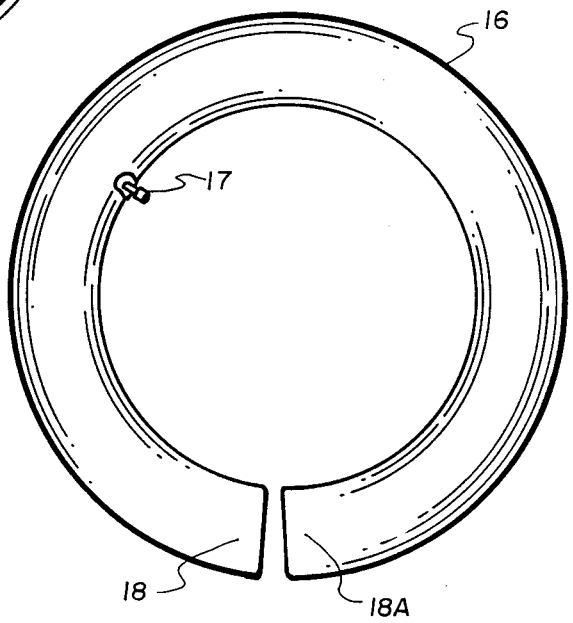
FIG. 2B is a too view of a less preferred assembly wherein the inflated tubing is used without an outer casing.

FIG. 2B is an illustration of the less preferred tubing free of the various features, such as back rest, pocket, apron, seat assembly etc. FIG. 2B shows the tubing 16 without the outer casing with the inflation valve 17 and the terminal ends 18 and 18A.

FIG. 3 is a top view of the new float device with the ends of the circular tube open. The outer casing of the device is shown as 11 with the tube inside as 13A. The back rest attached to the back of the casing is shown as 19 with zipper 34 which permits one to open the casing and introduce or adjust the material as a back rest, apron 33 attached to the side of the tube casing adapted to being pulled across the tube over the lap of the fisherman and attached to the other side of the tube by means of straps or hooks 20 and 21. The seat attached to the bottom inside of the tube casing is shown as 35 attached to a three way buckle 24 which in turn can be joined to latch means such as canvas straps 25 and 26 to join the seat to the front of the tubing. Storage container 22 is attached to the top of one side of the tube casing with zipper means 36 to permit one to open and store material therein. A pair of latch means at the terminal ends of the tube casing to latch the two ends together are shown as 27 and 28. 29 and 30 are rings attached to the casing to grasp and open the tubes for entering. Front covers for the ends of the tubing are shown as 31 and 32 which can be pulled together and locked by means of latch means 31A and 32A. Handle means 23 are attached to both sides of the tube device to assist in the handling or moving of the tube device.

Figure 4:
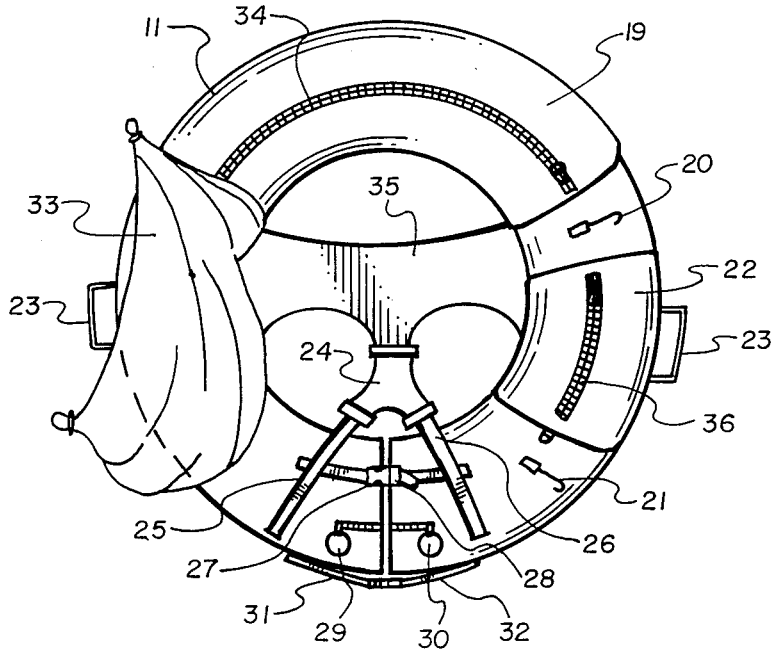
FIG. 4 is a top view of the new float device with the terminal ends of the tube in the closed position showing how the ends can be joined together.

FIG. 4 illustrates the float tube device wherein the ends of the circular tube have been brought together and latched by the above-noted latching means. The numbered items are as shown in FIG. 3 with the exception that the lock means 27 and 28 have been tightly locked together. The front covers 31 and 32 have also been locked together by latch means 31A and 32A. The front of the seat has been attached through 3 way buckle 24 to the front of the tubing means of latch means or straps 25 and 26.

Figure 5:
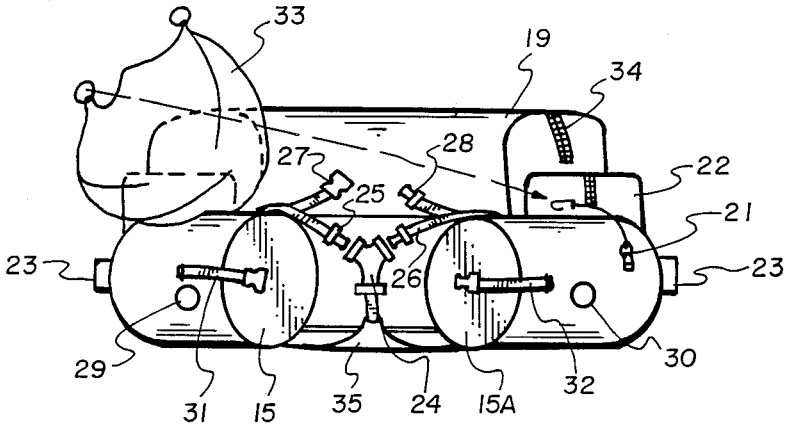
FIG. 5 is a front view of the circular tube in the open position.

With reference to FIG. 5 which is a front view of the unattached float device, the location of the seat at the bottom inside of the tube is shown as 35, the attachment of back rest 19, with zipper 34 to get into the back rest, the attachment 22 on both sides of the casing at the ton for storage containers, the apron 33 with attachment to hold the apron on the other side as 21, handles 23, latch means 27 and 28 to join with the 3 way buckle 24 joined to the seat cover 35, latch means 25 and 26 to latch the two ends of the tubing together and rings 29 and 30 to assist in the closing and opening of the tubing as needed. The terminal ends of the open tubing are shown as 15 and 15A.

Figure 6:
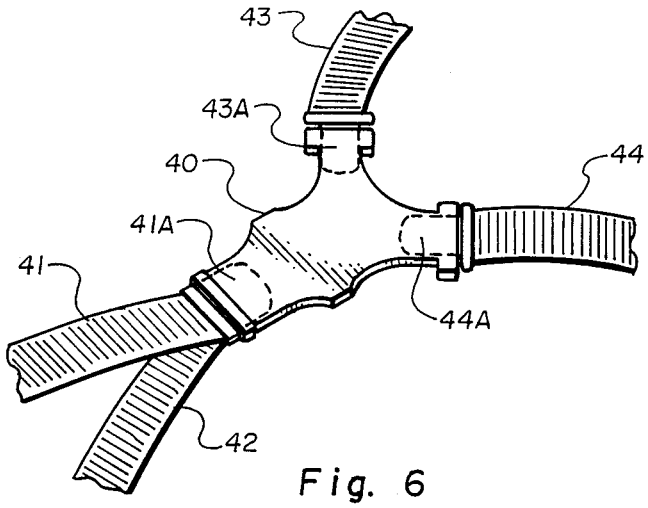
FIG. 6 is a top view of a buckle device showing how the front of the seat can be attached to the joining means on the terminal ends.

FIG. 6 is an illustration of the three way buckle that can be used to latch the end of the seat to the front of the tubing. The buckle is shown as 40, straps from the seat as 41 and 42, straps from the two terminal ends are shown as 43 and 44. The ends of the straps which enter the buckle are shown by the dotted lines 41A, 43A and 44A.

Figure 7:
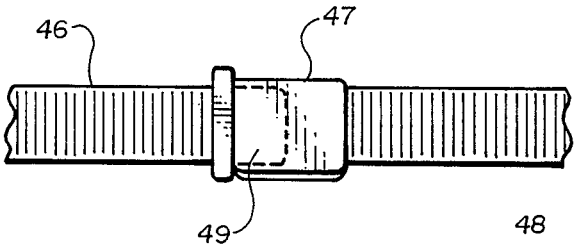
FIG. 7 is an illustration of a airplane type buckle that could be used to join the terminal ends together.

FIG. 7 is an illustration of another type of buckle, such as used in seat belts or airplane belts, which can be used to latch the ends of the tubing together. 47 is shown as the buckle with the straps 46 and 48. The end of the strap 46 entering the buckle is shown by dotted lines 49.

Figure 8:
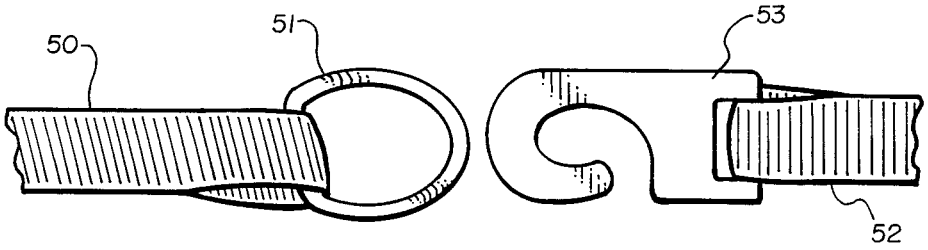
FIG. 8 is an illustration of another joining means comprising a ring and strap containing a hook means at the end.

FIG. 8 is another illustration of a type of latch means that can be employed. Shown is a metal ring 51 attached to strap 50. The other strap 52 has a metal hook 53 at the end thereof which can be easily hooked through ring 51 after the straps have been tightly pulled together.

DETAILED DESCRIPTION OF THE INVENTION

As shown in FIGS. 2A and 2B, the circular tubing can be made up of an outer casing with the inflatable tube inside, or the tubing can be made up of the inflatable tube itself. It is highly preferred to prepare an outer casing, such as of nylon canvas or other flexible but strong material to protect the inner inflatable tubing. Suitable material includes resin treated canvas, nylon sheeting, polypropylene tubing and the like. In general, the diameter of the inflatable tubing can vary as needed. In most cases it may vary say from about 8 to 12 inches. Conventional valve means should be present in order to permit rapid inflating and deflating of the tubing.

The latching means used to bring the terminal ends of the tubing together and to temporarily lock them in position as well as the latching means needed to join the front of the seat structure to the front of the tubing can be of any suitable construction as long as they accomplish their intended purpose. As shown in FIGS. 6 and 7 the latching means may be of the strap and buckle type wherein the ends of the straps are placed within and locked within the buckle, such as in the conventional car seat or air plane seat belts and of a material suitable for the wet conditions in which the seat is placed. The latching means may also be of the ring and strap type as shown in FIG. 8 wherein the ring is sewed to a strap and the other strap possesses a hook means which is hooked into the ring when the strap is pulled tight The hook can also be replaced with water resistant Velco means to help in tightening the strap.

The seat structure to be attached to the inside bottom of the tubing may be of any flexible tough material. As shown in the drawings, one side of the seat is attached to one inside bottom of the tubing and the other is attached to the other inside bottom edge, the back of the seat is preferably not attached to the back of the inside of the tubing. The front of the seat is attached to a locking means which is attached to the front and center of the tubing after the fisherman is in place. The preferred three way buckle used for this purpose is shown in FIG. 6.

The seat should of course be slightly oversize so that the circular tubing can be separated at the terminal end a sufficient distance to permit the fisherman to squeeze through the opening of the tubing. However, when the terminal ends are brought together, the seating structure should be sufficiently tight to permit the fisherman to sit thereon.

The seat should also be of such a construction as to provide openings at the front of the seat to permit the fisherman to place his legs down through and into the water below. The size of such openings can be varied as needed.

A variety of attachments can be added to the tube device for the convenience of the fisherman during use. For example, a back rest in the form of an additional tubing or pillow type attachment could be attached to the back of the tubing to provide a back rest for the fisherman as he sits on the seat. Preferably a casing for the back rest is attached to the circular casing and a zipper is provided for the additional casing so that an inflated tube or pillow can be inserted into the casing to form the back rest.

Side storage compartments can also be attached to one or both sides of the tubing as shown in the drawing. In this case, a casing is also preferably attached to the tube casing with zipper across such additional casings so that the required material can be inserted into the storage containers.

Handles can also be provided on one or both sides of the tube casing to provide easy movement of the tube device. Such handles can be of any composition or size as needed.

Also preferably provided on the side of the tubing is an apron or sheet material which is flexible and can be pulled across the lap of the fisherman after he is seated so as to provide him additional protection from the water as well as a place to place equipment or tackle during the use of the tubing. As shown in the drawing, the apron is preferably permanently attached to one side and the other end of the apron pulled across and latched at the other side by conventional means, such as hooks, Velcro straps, buckles, elastic chords, grommets, and the like.

Other attachments, such as drain plugs, grommets, hooks, and the like, may also be added as desired or needed.

While the above noted casing and attachments can be prepared singly and attached together, it is highly desirable to have a monolithic construction, i.e. one piece of material forming the casing, and the inflatable tube and maybe the accessories on the exterior.

The new floatable portable seats of the present invention can be utilized in any suitable manner. As noted, they are ideally suited for use by fisherman who desire to go out into a lake, pond or other bodies of water, and float along while they are fishing. The seats are preferably utilized for the above application by first securing a circular floatable tubing as noted above, inflating the tubing with the desired amount of air pressure so that the tubing will float, placing the inflated tubing around a fisherman's waist by passing the body of the fisherman through the opening in the circular tube, securing the two ends of the tubing together by joining means as shown above, and then attaching the front portion of the seat structure by joining means to the front of the tubing and allowing the legs of the fisherman to pass down both sides of said joining means. If desired, the apron can then be pulled across the lap of the fisherman and locked on the other side.

The additional equipment used by the fisherman, such as fins, flippers and wading boots, etc. can be added before the fisherman has placed the tubing around his waist.

DESCRIPTION OF THE PREFERRED EMBODIMENT

A floatable portable seat of the present invention was prepared as follows:

A circular casing of about 10 inches in diameter was prepared from thick nylon canvas and formed into a large circle of about 3 feet 6 inches. The circular casing was then cut at one point to form two terminal ends which were sealed with the same nylon canvas. A water resistant zipper was placed inside the casing to permit entry of a rubber tubing of slightly less diameter but sufficient to fill the entire casing. Valve means was placed in the rubber tubing to permit later inflation with air pressure.

A nylon case back rest with zipper was sewed to the back of the above casing to permit formation of a rest for the fisherman. The rest was approximately 24 inches long and 6 inches high and was filled with a rubber tubing with valve means for inflation.

A side pocket was also placed on both sides of the initial casing with water proof zippers to provide storage space. The pockets were approximately 8 inches long and 3 inches high.

An apron of nylon canvas was also attached to the initial casing on one side with elastic chord with heavy duty hooks on the end to be pulled over the tubing and hooked onto the rings attached to the apron. The apron was about 3 feet 6 inches in length and about 2 feet in width.

A seat structure was prepared from the nylon canvas in the shape shown in the drawings and sewed on the bottom sides of the casing. Nylon straps as shown in FIG. 6 were attached to the front end of the seat and then joined to a three sided buckle. Nylon straps were also attached to the casing at both ends to permit the front of the said seat to be attached to the front of of tube casing, said straps being able to be joined with the 3 way buckle noted above.

Nylon straps with buckles as shown in the drawings were also sewed to the ends to permit the closure of the two ends after the fisherman has squeezed into the opening in the tube casing.

The above floatable seat was then ready for testing. The tubing was then inflated with air pressure and a fisherman then squeezed through the opening at the terminal ends. When the fisherman was correctly placed, the ends were then latched together and the front of the seat attached to the front end of the tubing.

A tube was placed in the back rest and the apron was passed over the lap of the fisherman and locked on the other side.

So prepared, the fisherman was then ready to wade out into the pond and begin to fish.

For ease of understanding, the invention has been described above as using a tubing which is circular, but it is well within the scope of the invention to use tubing of any desired shape or size, such as square, rectangular, U shaped and the like tubing, as long as it meets the above-noted requirements.

It should be noted that for ease of understanding the invention has also been described as being prepared from a single split tube but it is well within the scope to include the use of tubing which has two or more discontinuous sections which may be joined together in any suitable means to provide the needed floating tube arrangement.

I claim as my invention:

1. A floatable portable seat adapted for supporting a person in sitting position and designed to be independently floatable in water and when placed in water with a person in the seat to give the appearance that the person is sitting on the surface of the water and permits the person sitting in the seat to have his arms free for fishing purposes, comprising in combination:

a. an inflatable tube possessing two terminal enclosed tube ends, which tube is discontinuous at at least one end point to provide the two terminal enclosed tube ends which can later be joined together to form a substantially complete tubing, b. joining means at each of the tube ends adapted to bringing the tube ends together and temporarily locking the tube ends together to form a continuous tubing, c. joining means at each of the tube ends adapted to attaching the tubing directly to the front end of the seat structure as in (d) below, d. an oversized seat structure attached directly to the bottom inside of the tubing near the part opposite the place where the two tube ends are joined, and extending out from the bottom of said tubing to give support to the person sitting thereon so that that person is sitting near the surface of the water and has his arms free for fishing, and e. said seat being of such a size as to permit the tubing to be opened to allow the person to squeeze between the two tube ends and get inside the tubing and when the tube ends are closed together to provide a seat structure sufficient to hold a person in the sitting position in the tubing near the surface of the water with his arms free for fishing and with openings in the seat to permit his legs to pass down under the tubing.

2. A floatable portable seat as in claim 1 wherein the tubing is circular.

3. A floatable portable seat as in claim 1 wherein a back rest is attached to the back top of the tubing.

4. A floatable portable seat as in claim 1 wherein an apron is attached to a side top of the tubing and is adapted to being pulled over the top of the tubing and removable attached to the other top side of the tubing.

5. A floatable portable seat as in claim 1 wherein handle means are attached to both sides of the tubing.

6. A floatable portable seat as in claim 1 wherein two storage containers are attached to the top side of the tubing for storage of fishing equipment.

7. A floatable portable seat as in claim 1 which is of monolithic construction and prepared from one piece of material.

* * * * *